US007016625B2

(12) United States Patent
Sekiguchi et al.

(10) Patent No.: US 7,016,625 B2
(45) Date of Patent: Mar. 21, 2006

(54) AIRFLOW AROUND ELECTRICAL CIRCUIT OF IMAGE FORMING APPARATUS

(75) Inventors: Hajime Sekiguchi, Kashiwa (JP); Makoto Kitahara, Abiko (JP); Yasuaki Otoguro, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 10/781,691

(22) Filed: Feb. 20, 2004

(65) Prior Publication Data

US 2004/0228646 A1 Nov. 18, 2004

(30) Foreign Application Priority Data

Feb. 24, 2003 (JP) ..... 2003-046115

(51) Int. Cl.
*G03G 21/20* (2006.01)

(52) U.S. Cl. ..... 399/92
(58) Field of Classification Search ..... 399/92
See application file for complete search history.

(56) References Cited

U.S. PATENT DOCUMENTS 4,447,856 A * 5/1984 Takahashi et al. ..... 361/692
6,115,564 A * 9/2000 Morimoto ..... 399/92
6,415,118 B1 * 7/2002 Setoriyama et al. ..... 399/92

FOREIGN PATENT DOCUMENTS

JP 11-186770 A 7/1999
JP 2000-216580 A 8/2000

* cited by examiner

*Primary Examiner*—Arthur T. Grimley
*Assistant Examiner*—Laura K. Roth
(74) *Attorney, Agent, or Firm*—Fitzpatrick, Cella, Harper & Scinto

(57) ABSTRACT

An image forming apparatus includes an image forming unit for forming an image; a first electrical substrate having an electric circuit for electric power supply to the image forming unit; a second electrical substrate disposed above the first electrical substrate and having an electric circuit for operating the image forming unit; an opening formed above the first electrical substrate in fluid communication with ambient air; and a partition member for partitioning the first electrical substrate and the second electrical substrate and for forming an air flow path from the first electrical substrate to the opening.

16 Claims, 5 Drawing Sheets

AIRFLOW AROUND ELECTRICAL CIRCUIT OF IMAGE FORMING APPARATUS

FIELD OF THE INVENTION AND RELATED ART

The present invention relates to an image forming apparatus, such as a copying machine, a printer, a facsimile machine, etc., which forms an image with the use of one of the electrophotographic methods. In particular, it relates to an image forming apparatus comprising a single or plurality of circuit boards having a single or plurality of heat generating portions.

In an image forming apparatus such as a copying machine, a printer, or a facsimile machine, an image is electrophotographically formed, in other words, with the use of a charging means for charging a photosensitive member, a developing means for forming an image of toner, a transferring means for transferring the image formed of toner a onto recording medium, a fixing means for fixing the unfixed image formed of toner on the recording medium to the recording medium, etc. Generally, an image forming apparatus is equipped with various circuit boards, for example, a circuit board having a current conversion circuit for converting the alternating current from a commercial power source, into direct current in order to supply the charging means and the like with direct current, and a circuit board having a control circuit for sending signals from a CPU (central processing unit) to various processing means. These circuit boards, that is, the current conversion circuit board, control circuit board, etc., are separately mounted in an image forming apparatus, according to their roles. Further, they are structured so that they can be placed in vertical alignment in order to minimize the spaces they occupy in the main assembly of an image forming apparatus.

Placing these circuit boards in vertical alignment, as described above, so that air is allowed to flow between the adjacent two boards creates a problem in that the heat generated by the electric current flowing through the circuit on the circuit board on the underside heats the circuit boards on the top side, reducing thereby the service lives of the electrical components on the circuit boards on the top side.

Japanese Laid-open Patent Application 2000-216580 discloses one of the solutions to this problem. According to this patent, a duct positioned between a circuit board and the heat source located below the circuit board is increased in thermal conductivity to more efficiently recover the heat from the heat source, in order to reduce the amount by which the heat from the heat source transfers to the circuit board above the heat source.

This structural arrangement, however, suffers from the following problem. That is, if an image forming operation is continuously carried out for a long time, the temperature of the aforementioned heat recovery portion increases, reaching eventually the temperature of the air flowing around the heat recovery portion. As a result, the rate at which heat transfers from the ambient air to the heat recovery portion, in other words, the heat from the heat source, is recovered by an insufficient amount. Thus, the portion of the heat from the heat source which the heat recovery portion fails to recover circumvents the duct, heating the circuit board above the duct. In other words, in order to completely eliminate the heat transfer from a first circuit board to a second circuit board, it is necessary to completely stop the heat transfer through the body of air between the first and second circuit boards. In order to completely stop the heat transfer through the body of air between the first and second circuit boards, it is required to place the first circuit board away from the second circuit board, and therefore, it is required to increase apparatus size.

One of the methods for avoiding the occurrences of this problem even if an image forming apparatus, which is not structured to completely stop the heat transfer through the body of air between the first and second circuit boards, is continuously used for a long time, is to exhaust the heat from the circuit board on the bottom side, out of an image forming apparatus before it reaches the circuit board on the top side, in order to reduce the amount by which the heat from below transfers to the circuit board on the top side.

As for the structure for exhausting heat into the ambience of an image forming apparatus, Japanese Laid-open Patent Application 11-186770 discloses an image forming apparatus having one circuit board as a heat source. In the case of this apparatus, the cover of its external shell is provided with an air vent, and the circuit board as a heat source is placed next to the air vent to exhaust the heat from the circuit board into the ambience of the apparatus.

If this structural arrangement disclosed in Japanese Laid-open Patent Application 11-186770 is simply adapted to an image forming apparatus in which circuit boards are placed in vertical alignment, the heat from the circuit board(s) on the bottom side must be exhausted through the circuit board(s) on the top side, along with the heat from the circuit board(s) on the top side. In other words, the heat from the circuit boards on the bottom side transfer to the circuit boards on the top side, thereby heating the circuit board(s) on the top side. In other words, the circuit board(s) on the top side are adversely affected by the heat from the circuit board(s) on the bottom side. In order to prevent this problem, it is desired that an image forming apparatus is structured so that the heat from the circuit board(s) on the bottom side is directly exhausted from the apparatus, that is, without being transferred through the circuit board(s) on the top side.

SUMMARY OF THE INVENTION

The primary object of the present invention is to exhaust the heat from a circuit board on the bottom side.

Another object of the present invention is to make it less likely for a circuit board on the top side to be affected by the heat from a circuit board on the bottom side.

Another object of the present invention is to provide an image forming apparatus comprising:

an image forming means for forming an image;

a first circuit board having an electrical circuit for supplying the image forming means with electrical power;

a second circuit board positioned above the first circuit board to control an image forming operation;

a hole positioned on the top side of the first circuit board and open to the ambience of the apparatus; and a partitioning member for guiding airflow from the first circuit board to the hole in order to thermally insulate the first circuit board from the second circuit board.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
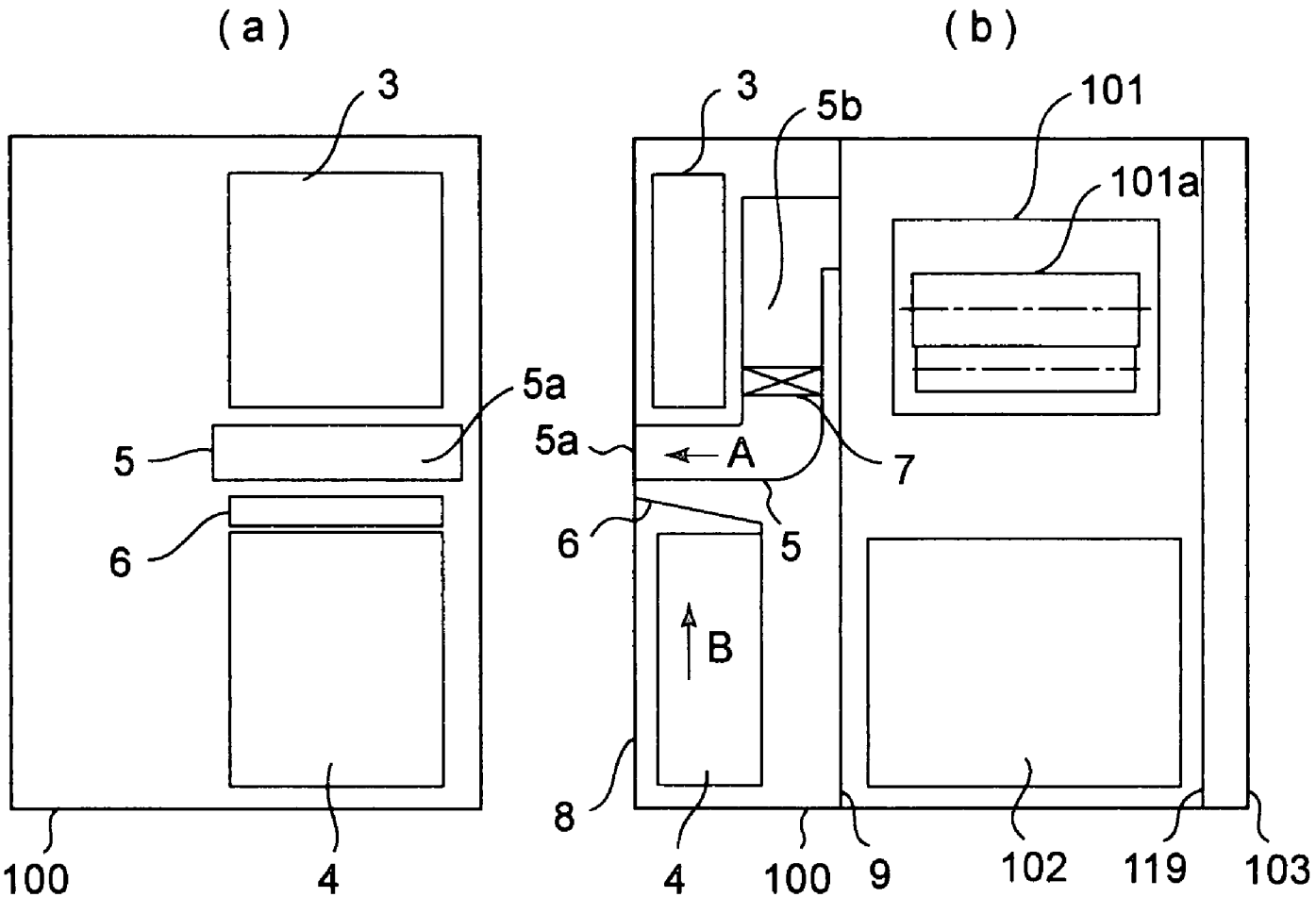
FIG. 1 is a schematic drawing showing the positioning of the components of the image forming apparatus in the first embodiment of the present invention, FIG. 1(*a*) and FIG. 1(*b*) being the rear and side views, respectively.

Hereinafter, the preferred embodiments of the present invention will be described in detail with reference to the appended drawings. The measurements, materials, and shapes of the structural components of the image forming apparatuses, and their positional relationship, in the following embodiments of the present invention, are not intended to limit the scope of the present invention, unless specifically noted.

First, referring to FIG. 3, the image forming process of the image forming means employed by the image forming apparatus in accordance with the present invention to form an image on a sheet of recording medium will be described.

An electrostatic latent image is formed by an exposing apparatus 30 as an exposing means, on a photosensitive drum 1 charged by a charging apparatus 2 as a charging means. The electrostatic latent image is sent to the development station as a developing means, in which it is turned into a toner image (image formed of toner). This toner image is transferred onto a belt 50 by a primary transfer roller 10 as a transferring means. Then, the toner image on the belt 50 is transferred by a secondary transfer roller 12 onto a sheet of recording medium P while the recording medium F is conveyed by sheet conveying apparatuses 105, 106, 107, and 108. After the transfer of the toner image onto the recording medium P, the recording medium P is conveyed to a fixing apparatus 101 as a fixing means, which comprises a pair of fixing rollers 101*a*. In the fixing apparatus 101, the unfixed toner image on the recording medium P is fixed to the recording medium P. Then, the recording medium P is discharged from the image forming apparatus by a pair of discharge rollers 110, ending a single sequence of image formation steps.

The sheet P is picked up by a pickup roller 105, and is sent to a pair of separation rollers 106. Then, it is conveyed to a pair of registration rollers 108 by a pair of vertical path rollers 107, and is released by the registration rollers 108 with a predetermined timing to be conveyed to the secondary transfer station.

Figure 3:
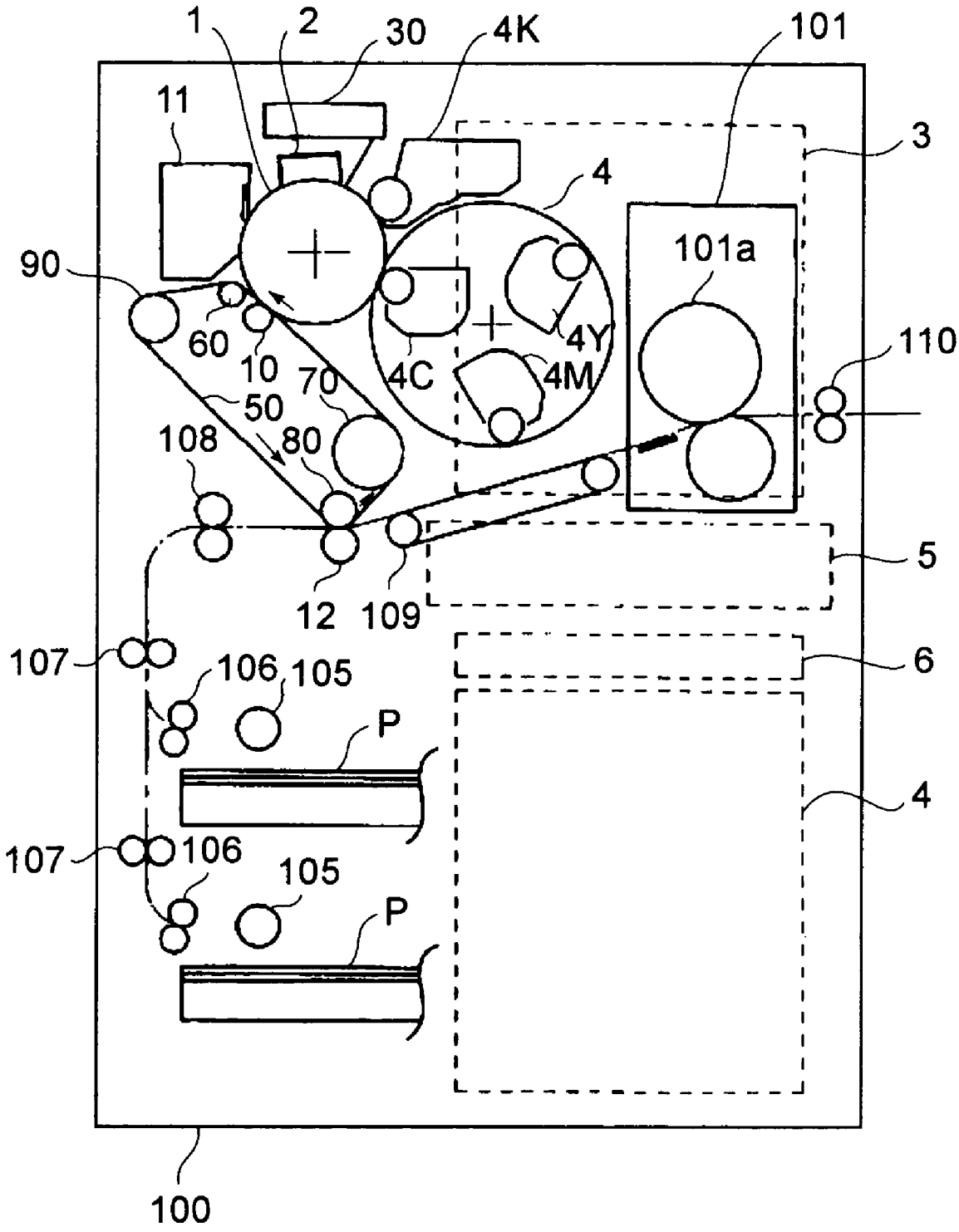
FIG. 3 is a schematic sectional view of the image forming apparatus in the first embodiment of the present invention.

The image forming apparatus in FIG. 3 comprises a rotary type color developing apparatus 4, which is structured to integrally hold a plurality of monochromatic developing apparatuses, that is, a yellow (Y) developing apparatus 4Y, a cyan (C) developing apparatus 4C, and a magenta (M) developing apparatus 4M, which use two-component toner. The black developing apparatus 4K uses single component toner, and therefore, does not yield development waste. Thus, it can be independently positioned from the other developing apparatuses in order to make it easier to use the image forming apparatus in the monochromatic (black) mode, which is greater in usage frequency that the multicolor mode.

(Embodiment 1)

FIG. 1(*a*) is a schematic drawing showing the positioning of the essential components of the image forming apparatus main assembly 100 in the first embodiment of the present invention, as seen from the rear, and FIG. 1(*b*) is a schematic drawing showing the positioning of the essential components, as seen from the side.

The image forming apparatus main assembly 100 comprises an image formation station, a sheet conveying portion 102, and a fixing apparatus 101, which are positioned between the front and rear panels 119 and 9, and also, between the unshown side covers. The front and rear panels 119 and 9 are covered with the front and rear covers 103 and 8, respectively. The front and rear panels 119 and 9 are the parts of the main frame of the main assembly 100.

The image forming apparatus in this embodiment is provided with a circuit board 3 as a second circuit board and a circuit board 4 as a first circuit board. The circuit board 3 is for controlling the image formation portion of the apparatus (which hereinafter will be referred to as "control circuit board 3"), and has heat generating portions. The circuit board 4 is for supplying the image forming apparatus with electrical power (which hereinafter will be referred to as "power source circuit board 4"), and has heat generation portions. The control circuit board 3 and power source circuit board 4 are positioned in vertical alignment, with the former being above the latter, as shown in FIG. 1, in which the circuit boards are schematically drawn.

Disposed between the control circuit board 3 and power source circuit board 4 is a duct 5 as an air passage. Within the duct 5, an axial fan 7, as an air blowing means for exhausting the internal air or taking in the external air, is disposed. As the axial fan 7 is turned on, the air in the duct 5 is flowed in the direction indicated by an arrow mark A, and is exhausted from the opening 5*a*. The air exhausted from the opening 5*a* of the air duct 5 is exhausted from the apparatus main assembly 100 through the air vent 85 of the rear cover 8 shown in FIG. 2.

As described above, in this embodiment, the control circuit board 3 and power source circuit board 4 are positioned in vertical alignment, and the duct 5 is positioned between the two circuit boards 3 and 4 in order to induce airflow within the image forming apparatus main assembly 100, by the exhaustion of the internal air from the apparatus main assembly through the duct 5, so that it becomes more difficult for the heat from the power source circuit board 4, or the bottom circuit board, to move upward to the control circuit board 3, or the top circuit board.

The duct 5 is also provided with an air passage 5*b* which runs between the rear panel 9, which is a part of the image forming apparatus main frame, and the control circuit board 3. Thus, not only does the duct 5 play the role of creating airflow in the main assembly, but also function as a heat exhaustion duct for exhausting the body of air having been heated by the heat from the fixing apparatus 101 of the image forming means.

While the fixing apparatus 101 is in operation, the surface temperature of the pair of fixation rollers 101*a* of the fixing apparatus 101 is kept at a relatively high temperature level, more specifically, about 200° C. Therefore, in order to prevent the electrical components such as a thermistor or a sheet sensor located around the fixation rollers, and the image formation station, from increasing in temperature due to the heat from the fixation rollers, the heat must be transferred away from the adjacencies of the fixing apparatus 101.

The control circuit board 3 of the image forming apparatus in this embodiment is located fairly close to one of the side walls of the fixing apparatus 101, making it necessary to prevent the heat from the fixing apparatus 101 from transferring to the control circuit board 3. Thus, the aforementioned rear panel 9 of the main frame of the image forming apparatus main assembly, and duct 5, which comprises the air passage 5*b*, are positioned between the control circuit board 3 and fixing apparatus 101. Thus, the ambient air of the fixing apparatus is exhausted through the duct 5 (air passage 5*b*) by the airflow generated by the axial fan 7. In other words, this air passage plays the role of preventing the heat from the fixing apparatus 101 from being transferred to the control circuit board 3.

As described above, the image forming apparatus in this embodiment is structured so that the two objectives, that is, removing the waste heat from the fixing apparatus 101, thermally insulating the control circuit board 3 from the fixing apparatus 101, and thermally insulating the control circuit board 3 from the power source circuit board 4, are accomplished with the employment of only the duct 5. This setup of providing the image forming apparatus with only the duct 5 as the thermally insulating means, however, is problematic in that if an image forming operation is substantial in length, the heat from the power source circuit board 4 circumvents the duct 5 and heats the control circuit board 3.

More specifically, as the power source circuit board 4 becomes heated, the body of air heated by the heat from the power source circuit board 4 flows upward (direction indicated by arrow mark B in FIG. 1). If this body of heated air flows to the control circuit board 3 located above the power source circuit board 4, the temperature of the control circuit board 3 rises, sometimes reaching a level at which the control circuit board 3 is adversely affected by the temperature. If the duct 5 or the like is the only component employed to thermally insulate the control circuit board 3, the heat from the power source circuit board 4 eventually transfers to the control circuit board 3 through the duct 5 or the like, because heat is continuously generated as long as the image forming operation continues. Thus, the heat from the power source circuit board 4 must be exhausted from the interior of the image forming apparatus main assembly 100. Thus, in this embodiment, in order to exhaust the heat from the power source circuit board 4, or the first circuit board, out of the apparatus main assembly, the apparatus main assembly 100 is provided with a partitioning member 6, as an airflow deflecting member, for guiding the heated air. The airflow guiding partitioning member 6 is disposed above the power source circuit board 4 in a manner to shield the control circuit board 3 from the power source circuit board 4. With the provision of this airflow deflecting member 6, the flow of the warm air generated by the heat from the power source circuit board 4 is directed toward the air vent 86 of the rear cover 8 shown in FIG. 2, so that it reaches the air vent 8 before it reaches the control circuit board 3. In other words, with the presence of this airflow deflecting partitioning member 6, the heat from the power source circuit board 4 is swiftly exhausted from the apparatus main assembly. Therefore, the amount by which the heat from the power source circuit board 4 circumvents the duct 5 or the like and reaches the control circuit board 3 is substantially smaller, making it possible for the image forming apparatus to flawlessly operate even if a given printing operation is very long.

Further, the partitioning member, or the airflow deflecting member 6, is diagonally positioned, making the air passage gradually widen toward the air vent 85. This tilting of the partitioning member 6 increases the air exhaustion efficiency, because of the natural convection of the warm (heated) air, that is, the natural upward movement of warm (heated) air. As a result, the body of warmer air from the inner part of the apparatus main assembly is drawn toward the air vent along the partitioning member 6.

It is possible that this airflow deflecting member 6 will eventually become warm and transfer heat to the control circuit board. Therefore, the airflow deflecting member 6 is desired to be formed of a thermally insulating substance such as resin.

Figure 2:
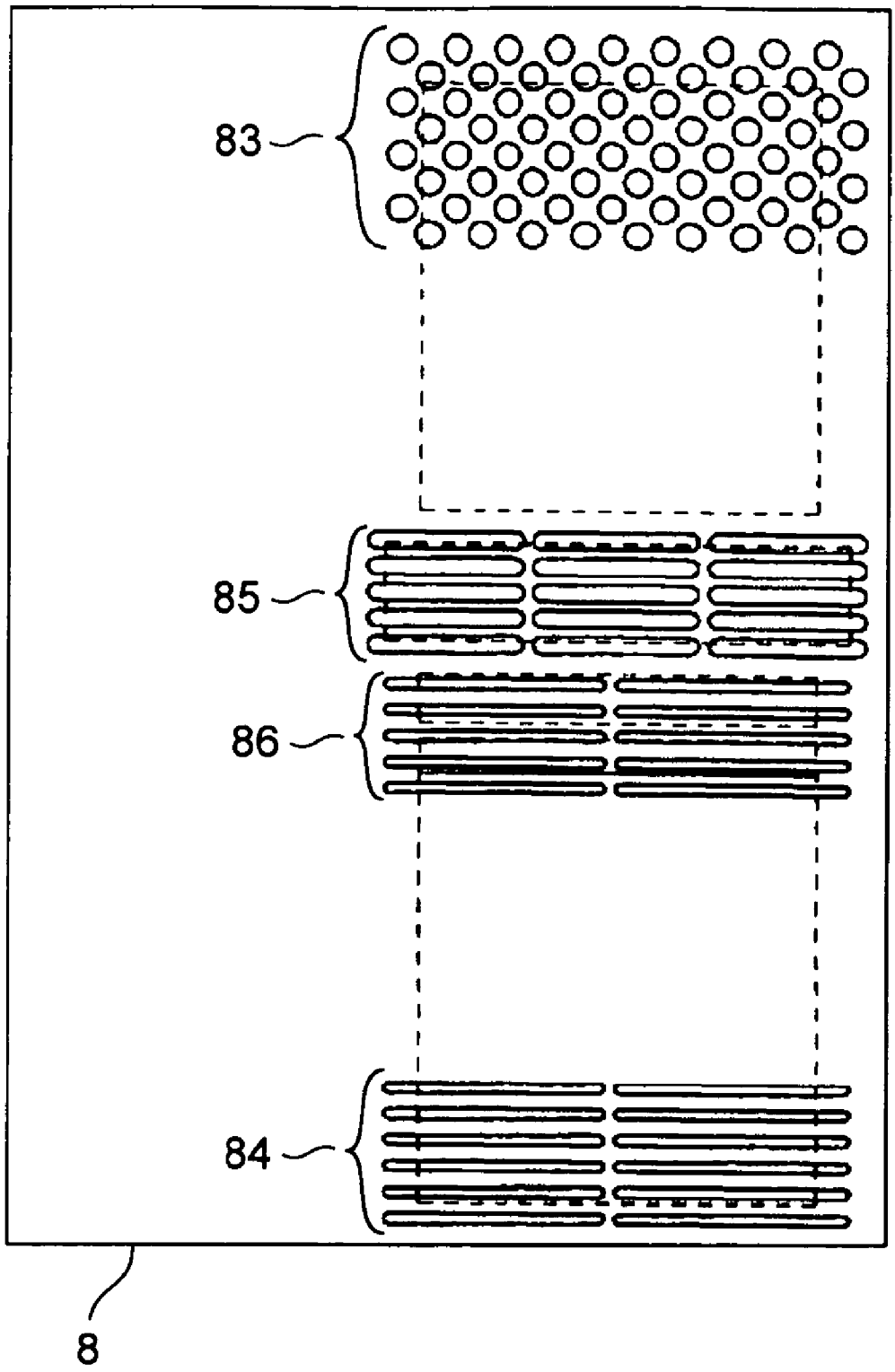
FIG. 2 is a plan view of the rear cover of the image forming apparatus in the first embodiment of the present invention.

FIG. 2 is a schematic drawing showing the various air vents of the rear cover 8 of the main assembly 100 of the image forming apparatus in this embodiment. As shown in FIG. 2, an air inlet 84 for enhancing the airflow in the direction indicated by an arrow mark B is located near the bottom of the power source circuit board 4, and an air vent 86 is located near the top of the power source circuit board 4 to allow the air to flow in the direction indicated by the arrow mark B and flow out of the apparatus main assembly. Further, the aforementioned air vent 85 is located in a manner to oppose the opening 5*a* of the duct 5 as described above. Although the amount of the heat generated by the control circuit board 3 is smaller than that by the power source circuit board 4, it still induces upward airflow (convection). Therefore, the rear panel 8 of the main assembly is provided with an air vent 83 in order to exhaust this convective airflow.

In other words, the external air is suctioned into the apparatus main assembly through the air inlet 84, and is exhausted through the air vent 86 by being guided by the airflow deflecting means 6, along with the heat generated in the apparatus main assembly. That is, the power source circuit board 4 is physically shielded from the control circuit board 3 so that the airflow generated by the heat from the power source circuit board 4 is kept away from the control circuit board 3. Therefore, even if the image forming apparatus in which a plurality of circuit boards are positioned in vertical alignment is continuously used for a long time for image formation, the heat from a power source circuit board on the bottom side is directly exhausted, minimizing the effect of the heat from the power source circuit board, upon the control circuit board.

The shapes of the holes of the above-described air intake and air vents are to be determined in consideration of the electrical noises and external design of the image forming apparatus, and are not to be limited to those shown in FIG. 2.

Also in this embodiment, the axial fan 7 is used as an air blowing means. However, the present invention does not limit the type of the air blowing means to an axial fan.

As described above, in the embodiment of the present invention, the image forming apparatus, in which a plurality of circuit boards are placed in vertical alignment, is provided with the air passage leading from the first circuit board to the air vent, and the partitioning member which thermally insulates the first circuit board from the second circuit board. Therefore, the heat from the bottom circuit board can be directly exhausted from the main assembly of the image forming apparatus, reducing substantially the amount by which the heat from the bottom circuit board is transferred to the top circuit board. Therefore, even if the image forming apparatus is used for a long image forming operation, no problem will occur.

(Embodiment 2)

Figure 4:
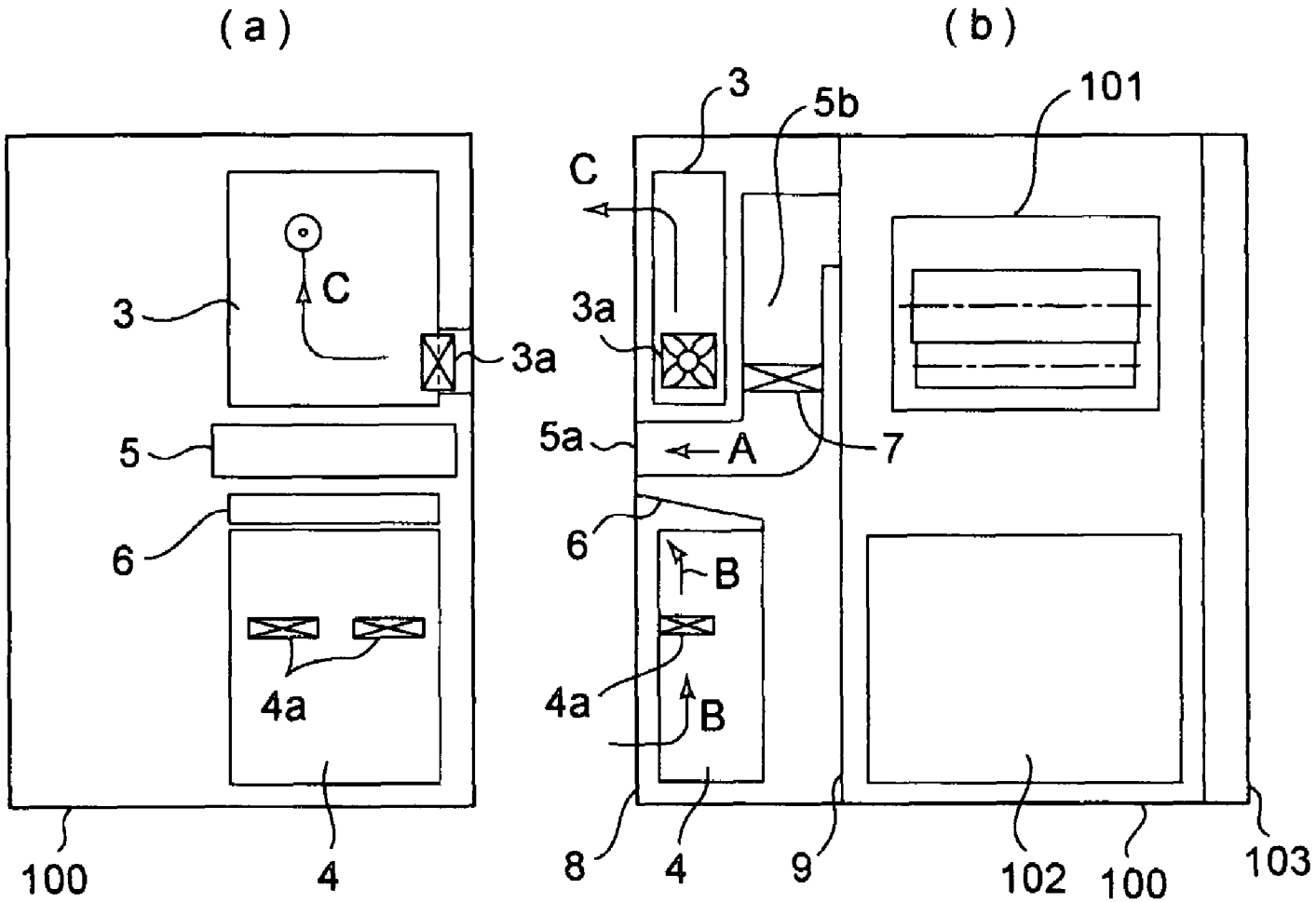
FIG. 4 is a schematic drawing showing the positioning of the components of the image forming apparatus in the second embodiment of the present invention, FIG. 4(*a*) and FIG. 4(*b*) being the rear and side views, respectively.

FIG. 4(*a*) is a schematic drawing showing the essential components in the main assembly 100 of the image forming apparatus in the second embodiment of the present invention, as seen from the rear, and FIG. 4(*b*) is a schematic drawing showing the same essential components shown in FIG. 4(*a*), as seen from the side. The components shown in FIG. 4, which are the same in function as those in the first embodiment, are given the same referential symbols as those given in the first embodiment, and will not be described here.

In the second embodiment, the control circuit board 3 is provided with a single axial fan, or an axial fan 3*a*, whereas the power source circuit board 4 is provided with two axial fans, or axial fans 4*a*. In order not to interfere with the airflow induced in the direction to move away from the power source circuit board 4, the axial fans 4*a* are rotated in the direction to blow the air in the same direction as the direction in which the air is moving away from the power source circuit board 4, in other words, toward the airflow deflecting means. The air blowing means of the control circuit board 3 is structured to take the external air into the main assembly in the direction roughly perpendicular to the direction in which the internal air is exhausted through the duct 5 as an air passage.

In this embodiment, the fresh outside air is blown onto the control circuit board 3 by the axial fan 3*a* of the control circuit board 3 through the opening of the side panel (parallel to surface of paper on which FIG. 4 is drawn) of the apparatus main assembly shown in FIG. 4(*b*). After the fresh outside air is blown onto the control circuit board 3, it flows in the direction indicated by an arrow mark C in FIG. 4(*a*), and is exhausted from the apparatus main assembly through the air vent 83 (FIG. 2) of the rear cover 8.

Since the axial fan 3*a* as an air blowing means is positioned so that the fresh outside air is suctioned into the apparatus main assembly from the direction roughly perpendicular to the direction in which the internal air is exhausted through the duct 5, the body of heated air exhausted through the duct 5 is not suctioned back into the apparatus main assembly; only the fresh outside air is suctioned into the apparatus main assembly. Therefore, the heat from the control circuit board 3 is efficiently exhausted from the apparatus main assembly.

Also in this embodiment, the fresh outside air is taken into the apparatus main assembly and is blown onto the power source circuit board 4 by the axial fans 4*a* of the power source circuit board 4 through the air inlet 84 of the rear cover 8 shown in FIG. 2. As it is blown onto the power source circuit board 4, it flows in the direction indicated by an arrow mark B, and is exhausted from the apparatus main assembly through the air vent 86 of the rear cover 8.

Providing the control circuit board 3 and power source circuit board 4 with dedicated air blowing means as in this embodiment makes it possible to devise a proper countermeasure to deal, as necessary, with the excess amount of heat generated in the apparatus main assembly, in accordance with the structure of a given image forming apparatus, and also to satisfactorily exhaust the internal heat even if the amount of the excessive heat generated by the power source circuit board 4 is substantial.

As described above, according to this embodiment, the heat from the bottom circuit board in the image forming apparatus in which a plurality of circuit boards are placed in vertical alignment can be directly exhausted from the apparatus main assembly. Therefore, the amount by which heat is transferred from the bottom circuit board to the top circuit board is substantially smaller, making it possible for the image forming apparatus to be continuously operated for a long image forming operation.

(Embodiment 3)

Figure 5:
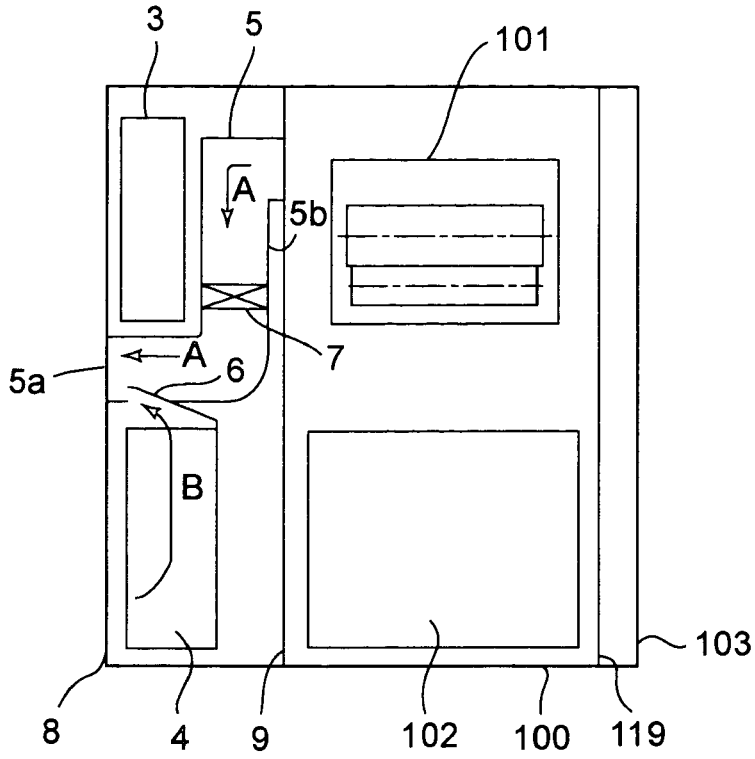
FIG. 5 is a schematic drawing showing the positioning of the components of the image forming apparatus in the third embodiment of the present invention, as seen from the side.

FIG. 5 is a schematic drawing showing the essential components in the image forming apparatus 100 in the third embodiment of the present invention, as seen from the side. The components shown in FIG. 5, which are the same in function as those in the first embodiment, are given the same referential symbols as those given in the first embodiment, and will not be described here.

In this embodiment, the wall of the duct 5 is provided with a hole, which is on the power source circuit board 4 side, as shown in FIG. 5. Further, the power source circuit board 4 is provided with an airflow deflecting member 6. Therefore, the airflow induced upwardly by the heat from the power source circuit board 4 is guided into the duct 5 located between the control circuit board 3 and power source circuit board 4, and is made to join the airflow in the duct 5, so that it will be exhausted from the apparatus main assembly along with the airflow in the duct 5.

In the case of the above-described setup, a pressure difference occurs between the strong airflow induced by the axial fan 7 located in the duct 5, and the airflow induced by the heat from the power source circuit board 4, in adjacencies of where the edge of the airflow deflecting member 6 is projecting into the duct 5, and this pressure difference acts to draw the airflow induced by the heat from the power source circuit board 4, into the duct 5.

As described above, the third embodiment is effective to enhance the natural convection, that is, the upward airflow generated by the heat from the power source circuit board 4, by the strong airflow induced in the duct 5 by the axial fan 7 located in the duct 5.

The duct 5 and airflow deflecting member 6 in this embodiment may be integrated. Not only does the integration better seal the joint between the duct 5 and airflow deflecting member 6, but also reduces the component count, increasing thereby manufacturing efficiency. Consequently, it reduces apparatus cost.

This embodiment makes it possible to efficiently exhaust the heat from the power source circuit board 4, without providing the power source circuit board 4 with an air blowing means, such as the axial fan or the like in the second embodiment, making it thereby possible to reduce the component count. Therefore, this embodiment makes it possible to reduce apparatus cost.

(Embodiment 4)

Figure 6:
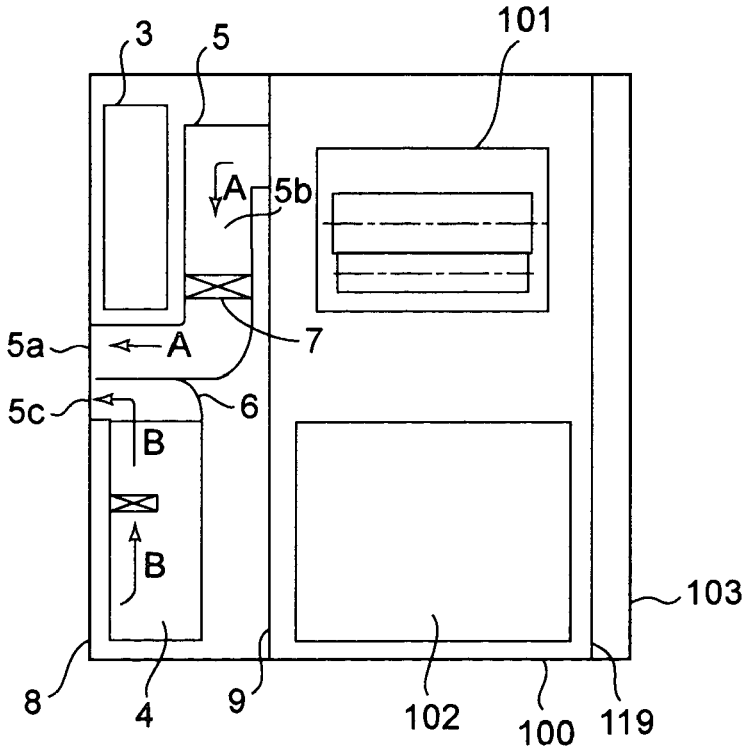
FIG. 6 is a schematic drawing showing the positioning of the components of the image forming apparatus in the fourth embodiment of the present invention.

FIG. 6 is a schematic drawing showing the essential components in the image forming apparatus 100 in the fourth embodiment of the present invention, as seen from the side. The components shown in FIG. 6, which are the same in function as those in the first embodiment, are given the same referential symbols as those given in the first embodiment, and will not be described here.

Referring to FIG. 6, the power source circuit board 4 in the fourth embodiment is similar to the power source circuit board 4 in the first embodiment, but is provided with an axial fan 4*a* as is the power source circuit board 4 in the second embodiment. Further, the duct 5 and airflow deflecting member 6 are integrated, and are provided with an opening 5*a*, through which the heat generated by the fixing apparatus is exhausted, and the opening 5*c*, through which the upward airflow induced by the heat from the power source circuit board 4 is guided out of the image forming apparatus main assembly, respectively.

If the duct 5 and airflow deflecting member 6 are partially integrated as in the third embodiment, a complex airflow is created in the adjacencies of where the airflow induced by the heat from the power source circuit board 4 and the airflow generated by the air blowing means to exhaust the heat from the fixing apparatus, making it difficult to airtightly seal the joint between the duct 5 and airflow deflecting member 6. In this embodiment, however, the joint between the duct 5 and airflow deflecting member 6 is formed as an integral part of the duct 5. Therefore, the joint is better sealed. The integration of the duct 5 and airflow deflecting member 6 makes it possible to reduce component count, increasing thereby manufacturing efficiency. Thus, the integration can reduce apparatus cost.

The shape of the airflow deflecting member 6 in accordance with the present invention may be modified as necessary in accordance with the shape of the duct 5, performance of the axial fan 7, etc. The shape of the airflow deflecting member 6 should be optimized in accordance with the shape of the opening 5*c*, positional relationship between the airflow deflecting member 6 and duct 5, and the like factors, through computer simulations, actual experiments, etc.

As will be evident from the above description, the fourth embodiment is one of the combinations among the first to third embodiments. The first to third embodiments may be integrated in any combination in accordance with the amount of the heat generated by the circuit boards and the structure of the image forming apparatus to which the present invention is applied, based on studies made with the use of actual experiments, simulations, etc.

The application of the present invention is not limited to a developing apparatus of the rotary type. In other words, not only is the present invention usable to properly position circuit boards in an image forming apparatus comprising a developing apparatus of the rotary type, but also in an image forming apparatus comprising four drums, an image forming apparatus having no intermediary transfer station, or the like image forming apparatuses.

Further, the application of the present invention is not limited to the positioning of the first circuit board as a control circuit board and second circuit board as a power source circuit board relative to each other; the present invention is also applicable to circuit boards other than the power source circuit board and control circuit board.

The present invention does not limit the positional relationship among a plurality of circuit boards; the application of the present invention is not limited to the positional relationship between the control circuit board and power source circuit board as that in the preceding embodiments. In other words, the positional relationship, in terms of the vertical direction, between given two circuit boards, may be determined at apparatus designer's discretion.

The axial fans employed in the preceding embodiments of the present invention may be turned on during a standby period, as well as during an image formation period. The sequence in which the axial fans are to be turned on is to be created based on the results of the studies made regarding the temperature increase, noises, etc., in various portions of an image forming apparatus; the axial fan activation sequences in the preceding embodiments are not intended to limit the scope of the present invention.

As described above, according to the present invention, an image forming apparatus, in which a plurality of circuit boards are positioned in vertical alignment, is provided with an air passage leading from a first circuit board to the opening of the external panel of the image forming apparatus, and a partitioning member which thermally insulates between the first and second circuit boards. Therefore, the heat generated by the circuit board located in the bottom portion of the apparatus main assembly is directly exhausted from the apparatus main assembly, reducing the amount by which the heat from the circuit board located below a given circuit board is transferred to the given circuit board. Therefore, the image forming apparatus can be continuously used for an image forming operation even if the operation is very long.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

image forming means for forming an image;

a first electrical substrate having an electric circuit for electric power supply to said image forming means;

a second electrical substrate disposed above said first electrical substrate and having an electric circuit for operating said image forming means;

an opening for discharging heat to outside of said image forming apparatus; and a guiding member, disposed between said first electrical substrate and said second electrical substrate, for guiding heat of said first electrical substrate to said opening, said guiding member having an inclined portion inclined upwardly toward said opening.

2. An apparatus according to claim 1, further comprising an additional opening which is disposed adjacent a bottom side of said first electrical substrate and which is in fluid communication with the outside.

3. An apparatus according to claim 1, further comprising fan means for directing air from said first electrical circuit toward said guiding member.

4. An apparatus according to claim 1, wherein said second electrical substrate includes an electric circuit for controlling said image forming means.

5. An apparatus according to claim 1, further comprising a duct between said first electrical substrate and said second electrical substrate for discharging heat from said image forming means to the outside.

6. An apparatus according to claim 5, wherein said duct is disposed between said guide member and said second electrical substrate.

7. An apparatus according to claim 5, wherein said duct has a length measured in a direction perpendicular to a guiding direction of said guiding member greater than a length of said first electrical substrate measured in the perpendicular direction.

8. An apparatus according to claim 1, wherein said guiding member is made of a heat insulation member.

9. An image forming apparatus comprising:

image forming means for forming an image;

a first electrical substrate having an electric circuit for electric power supply to said image forming means;

a second electrical substrate disposed above said first electrical substrate and having an electric circuit for operating said image forming means;

an opening for discharging heat to outside of said image forming apparatus; and an air flow forming member, disposed between said first electrical substrate and said second electrical substrate, for directing heat of said first electrical substrate to said opening, said air flow forming member having an inclined portion inclined upwardly toward said opening.

10. An apparatus according to claim 9, further comprising an additional opening which is disposed adjacent a bottom side of said first electrical substrate and which is in fluid communication with the outside.

11. An apparatus according to claim 9, further comprising fan means for directing air from said first electrical circuit toward said directing member.

12. An apparatus according to claim 9, wherein said second electrical substrate includes an electric circuit for controlling said image forming means.

13. An apparatus according to claim 9, further comprising a duct between said first electrical substrate and said second electrical substrate for discharging heat from said image forming means to the outside.

14. An apparatus according to claim 13, wherein said duct is disposed between said air flow forming member and said second electrical substrate.

15. An apparatus according to claim 13, wherein said duct has a length measured in a direction perpendicular to a directing direction of said air flow forming member greater than a length of said first electrical substrate measured in the perpendicular direction.

16. An apparatus according to claim 9, wherein said air flow forming member is made of a heat insulation member.

* * * * *

UNITED STATES PATENT AND TRADEMARK OFFICE

CERTIFICATE OF CORRECTION

PATENT NO. : 7,016,625 B2
APPLICATION NO. : 10/781691
DATED : March 21, 2006
INVENTOR(S) : Hajime Sekiguchi et al.

It is certified that error appears in the above-identified patent and that said Letters Patent is hereby corrected as shown below:

COLUMN 1:
Line 20, "a onto" should read --onto a--.

COLUMN 3:
Line 42, "medium F" should read --medium P--.

COLUMN 4:
Line 4, "that the" should read --than the--.

COLUMN 9:
Line 56, "given two" should read --two given--.
Line 57, "apparatus" should read --an apparatus--.

Signed and Sealed this

Nineteenth Day of June, 2007

JON W. DUDAS
*Director of the United States Patent and Trademark Office*